United States Patent [19]

Seto et al.

[11] Patent Number: 4,588,315

[45] **Date of Patent: * May 13, 1986**

[54] HEAT-SENSITIVE COLOR TRANSFER RECORDING MEDIA AND PRINTING PROCESS USING THE SAME

[75] Inventors: Tadao Seto, Odawara; Yoshikazu Shimazaki, Osaka, both of Japan

[73] Assignee: Fuji Kagakushi Kogyo Co., Ltd., Osaka, Japan

[ * ] Notice: The portion of the term of this patent subsequent to Feb. 25, 2003 has been disclaimed.

[21] Appl. No.: 682,871

[22] Filed: Dec. 18, 1984

Related U.S. Application Data

[63] Continuation-in-part of Ser. No. 465,017, Feb. 8, 1983, Pat. No. 4,503,095.

[30] Foreign Application Priority Data

Feb. 13, 1982 [JP] Japan ..... 57-21571
Feb. 13, 1982 [JP] Japan ..... 57-21572

[51] Int. Cl.[4] ..... B41J 3/20

[52] U.S. Cl. ..... 400/120; 400/240.3; 427/265

[58] Field of Search ..... 400/120, 240.4; 427/265

[56] References Cited

U.S. PATENT DOCUMENTS

| | | | |
|---|---|---|---|
| 3,461,998 | 8/1969 | Ploeger, Jr. | 400/241.4 |
| 3,744,611 | 7/1973 | Mantanari et al. | 400/120 |
| 3,855,448 | 12/1974 | Hanagata | 400/120 |
| 4,046,073 | 9/1977 | Mitchell et al. | 400/120 |
| 4,103,066 | 7/1978 | Brooks et al. | 428/337 |
| 4,195,937 | 4/1980 | Baran | 400/120 |
| 4,251,276 | 2/1981 | Ferree, Jr. et al. | 400/120 |
| 4,280,767 | 7/1981 | Heath | 400/240.4 |

*Primary Examiner*—William Pieprz
*Attorney, Agent, or Firm*—Armstrong, Nikaido, Marmelstein & Kubovcik

[57] ABSTRACT

A heat-sensitive color transfer recording media which comprises a continuous foundation comprising an electroresistive layer and an electrically conductive layer; and a multiplicity of coated areas of heat-sensitive transfer inks applied onto the foundation; the multiplicity of the coated areas being disposed on the continuous foundation side by side so as to traverse continuous foundation; the multiplicity of the coated areas being arranged sequentially in the longitudinal direction of the continuous foundation in a repeating unit which comprises a plurality of different color coated areas; each of the different color coated areas included in the repeating unit having a length in the longitudinal direction of the continuous foundation substantially equal to the length or width of a receiving medium; each of the heat-sensitive transfer ink layers of the coated areas being a transparent ink layer comprising a transparent coloring agent and a transparent hot-melt vehicle; and said plurality of the different color heat-sensitive transfer ink layers of the coated areas of the recording media being transferred onto the receiving medium so that different color ink images are superimposed on the receiving medium to give a color image. By employing the recording media, a color copy having a clear color image with a high resolution can be obtained at low cost according to electroresistive recording system.

12 Claims, 13 Drawing Figures

HEAT-SENSITIVE COLOR TRANSFER RECORDING MEDIA AND PRINTING PROCESS USING THE SAME

CROSS-REFERENCE TO RELATED APPLICATION

This is a continuation-in-part of application Ser. No. 465,017 filed on Feb. 8, 1983, now U.S. Pat. No. 4,503,095.

BACKGROUND OF THE INVENTION

The present invention relates to a novel heat-sensitive color transfer recording media and a printing process using the recording media. More particularly, it relates to a heat-sensitive color transfer recording media suitable for producing color images in electroresistive recording system.

In recent years, electoresistive recording system as well as thermal recording system using thermal printer or thermal facsimile have been rapidly developed because of their advantages such as low noise, maintenance free and low cost. The principle of the electroresistive recording system is shown in FIG. 1. A recording media 100 used in the electroresistive recording system is usually composed of an electroresistive layer 101, an electrically conductive layer 102 and a heat-sensitive ink layer 103. A printing head 110 used in the electroresistive recording system is composed of a plurality of needle-like electrodes 111 held electrically insulated from each other in a fixed relationship by insulation. The printing head 110 is brought in contact to the electroresistive layer 101 of the media 100. Thus, an electric circuit can be established through any one of the electrodes 111 activated selectively, the electroresistive layer 101 and a return electrode 112 which is grounded. In that case, an electric current applied to the electroresistive layer 101 from the electrode 111 flows to an electrically conductive layer 102 through the electroresistive layer 101 due to the suitable electric resistance of the electroresistive layer 101, by which Joule heat is generated. The Joule heat causes the melting of the heat-sensitive ink layer 103 and the melted ink 103*a* is transferred onto a receiving medium 105, such as plain paper.

Known electroresistive recording system is of the type producing a duplicate of single color such as black, blue or red, and there is a strong desire for electroresistive recording system capable of producing multi-color images.

In color recording system technologies, there are known an impact recording system as seen in a conventional typewriter in which a cloth ribbon, e.g. a ribbon coated with inks of two colors, is employed; and an ink-jet recording system in which inks are jetted by employing two or more ink-jet heads. The former has the disadvantages of generating much noise and slow recording speed. Also, the latter has the disadvantage that problems such as clogging of the nozzle for jetting out ink tend to occur since the ink is jetted through the nozzles having a very narrow opening, and since the amount of ink jetted must be controlled, the apparatus itself is very complicated and expensive and the operation thereof is also complicated.

Recently, to make available a color printing system which overcomes the aforementioned problems, there has been proposed a color recording system utilizing the principle of color television and color phototelegraphy. FIG. 2 is a diagrammatic view showing such a color recording system. A color original 1 is subjected to color separation by filters 2*a*, 2*b* and 2*c*. The respective color-separated images are then read by photoelectric tubes 3*a*, 3*b* and 3*c* and are converted into yellow signal Y, cyan signal C and magenta signal M. The signals are transmitted from a transmitter 4 to a receiver 5 at which the signal separation is conducted again. The signals are transmitted to a printer 6 to reproduce a color image which closely resembles the original, on a copy sheet 7. Recording machines applicable to such a system have been proposed and developed. The application of a printer for electroresistive recording system to the printer 6 is advantageous from view-points of low cost, ease of operation, low noise and high printing speed.

Conventionally known color image forming processes by the thermal color recording system include a process employed in a thermal color printer which makes it possible to obtain multi-color images in a single treatment as disclosed in Japanese Patent Unexamined Publication (Tokkyo Kokai) No. 156647/1979. This process uses a recording media comprising a foundation and heat-sentive ink spots provided thereon wherein 4-color ink spots of yellow, magenta, cyan and black colors are arranged in rhomboid cells and the rhomboid cells are disposed side by side in parallel rows which extend across the foundation. The thermal head used in this process is composed of a double row of heating elements arranged in rhomboid cells corresponding to the rhomboid cells of ink spots. Minute spots of different colors are transferred from the recording media onto a copy sheet by heating with the thermal head so that different color spots are not superimposed with each other to form a color image. The publication also discloses another process wherein there are used a recording media which has parallel stripes of heat-sensitive inks of the above four colors on a foundation, the stripes extending perpendicular to the travel direction of the recording media and being disposed in a repeating series of four colors (each stripe has a very narrow width of about 0.23 mm.) and a thermal head which has heating elements(dots) arranged in a single row, whereby each color is transferred line-to-line (width of each line: about 0.23 mm. and space between the lines: 0.025 mm.) on a copy sheet.

However, the above processes have problems that the color resolution is not satisfactory and also positions between the recording media and the copy sheet cannot easily be adjusted and, therefore, it is very difficult to obtain clear color images.

In particular, since each of the heat-sensitive ink spots or stripes disclosed in the above publication contains sublimiable dyes which are sublimated by the heating with a thermal head upon printing and deposited on a copy sheet, the use of the heat-sensitive recording media proposed therein accompanies fatal disadvantages that heat control of the thermal head is very difficult during printing and also the dyes of each color tend to be sublimated and mixed with each other during the storage of the media, whereby clear images cannot be obtained.

It is an object of the present invention to provide a heat-sensitive color transfer recording media which can be used in an electroresistive recording system to give clear multi-color images of high resolution at low cost.

Another object of the present invention is to provide a heat-sensitive color transfer recording media which makes it possible to use a low cost, small-size color printer for electroresistive recording system.

A further object of the present invention is to provide a heat-sensitive color transfer recording media suitable for high-speed color recording.

A still further object of the present invention is to provide a process for producing color images on a receiving medium such as plain paper according to an electroresistive recording system.

These and other objects of the present invention will become apparent from the description hereinafter.

SUMMARY OF THE INVENTION

According to the present invention, there is provided a heat-sensitive color transfer recording media which comprises a continuous foundation comprising an electroresistive layer and an electrically conductive layer; and a multiplicity of coated areas of heat-sensitive transfer inks applied onto the foundation; the multiplicity of the coated areas being disposed on the continuous foundation side by side so as to traverse the continuous foundation; the multiplicity of the coated areas being arranged sequentially in the longitudinal direction of the continuous foundation in a repeating unit which comprises a plurality of coated areas of different colors, at least yellow, magenta and cyan; each of the different color coated areas included in the repeating unit having a length in the longitudinal direction of the continuous foundation substantially equal to the length or width of a receiving medium; and each of the heat-sensitive transfer ink layers of the coated areas being a transparent ink layer comprising a transparent coloring agent and a transparent hot-melt vehicle. Thus, the present invention provides a heat-sensitive color transfer recording media capable of producing color copy by superimposing two or more different color ink images onto the receiving medium by means of electroresistive printing.

DETAILED DESCRIPTION OF THE INVENTION

Figure 1:
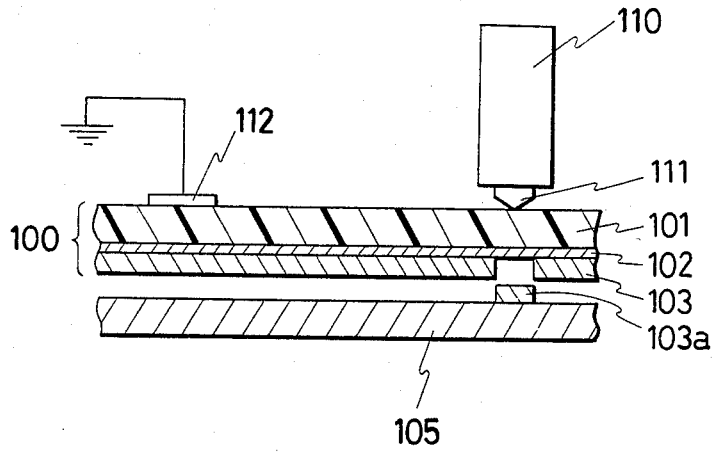
FIG. 1 is a schematic view showing the principle of electroresistive recording system.
Figure 2:
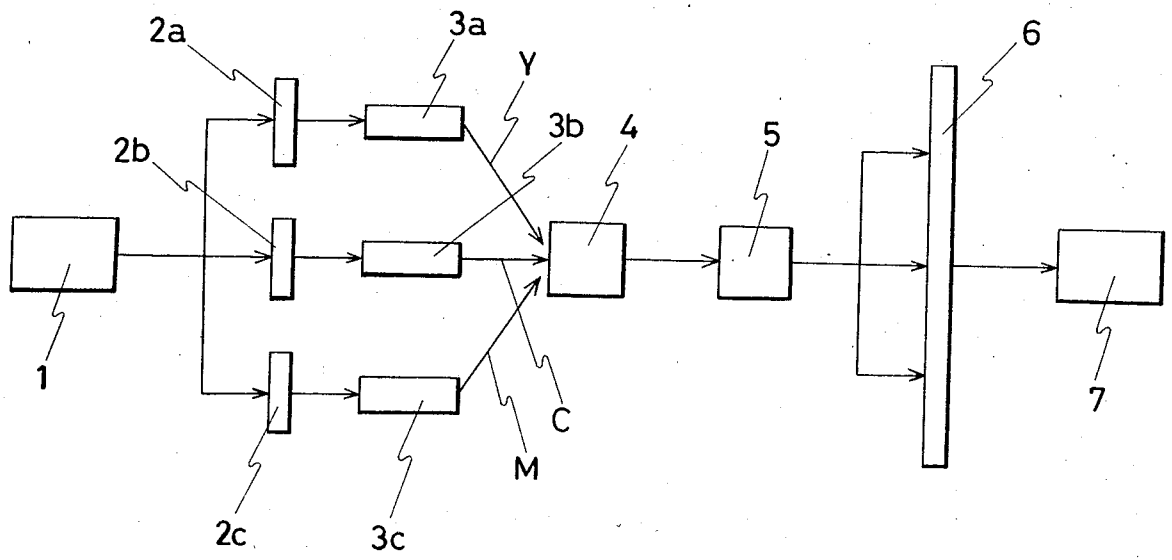
FIG. 2 is a diagrammatic view showing a color recording system.

The heat-sensitive color transfer recording media of the present invention is used for forming a multi-color image on a copy sheet by successively transferring a plurality of heat-sensitive transfer ink layers of different colors, at least three primary colors, i.e. yellow, magenta and cyan, which constitute the coated areas included in each repeating unit, onto the copy sheet so that two or more different color ink images are superimposed on the copy sheet.

That is, the formation of a color image using the recording media of the present invention can be performed by superimposing two or three color images of yellow, magenta and cyan on the copy sheet.

More specifically, in the present invention, the different color ink layers are successively melt-transferred onto substantially the same position of the copy sheet in the form of spot(dot) corresponding to each of the electrodes of an electroresistive printing head. Colors other than primary pure yellow, cyan and magenta, such as red, blue, green, black, etc. can be formed by superimposing two or three of yellow, cyan and magenta ink spots. In the present invention, the transferred different color ink spots are present on the copy sheet in such a state that they are not substantially admixed with each other but they are stacked in the form of layer. Such superimposing of the different color ink spots ensures a suitable color mixture (subtractive color mixture) to give a clear multi-color image, without undesirable phenomena such as blur of the printed image and ununiformity of color. Accordingly, each of the ink layers in the recording media of the present invention must be highly transparent, and otherwise, a clear color image with a good color reproduction cannot be obtained.

In the present invention, the visible light transmittance of each ink layer of yellow, magenta or cyan is preferably not less than 68%, more preferably not less than 80%. In order to obtain each ink layer having the above transmittance, it is necessary to use a coloring agent having a high transparency and a hot-melt vehicle (such as binders and softening agents) having a high transparency. Further, the coloring agent and hot-melt vehicle used in each ink layer preferably should have near refractive indicies from each other.

In the present invention, the term "transparent coloring agent" means a coloring agent capable of giving a transparent ink layer when the coloring agent is admixed with a transparent hot-melt vehicle composed of a binder, a softening agent, etc.

The transparent yellow coloring agents used in the yellow ink layer include pigments such as Chrome Yellow (lead chromate), Zinc Yellow (basic zinc chromate), Lemon Yellow (barium chromate), Cadmium Yellow, Naphthol Yellow S, Hansa Yellow 5G, Hansa Yellow 3G, Hansa Yellow G, Hansa Yellow GR, Hansa Yellow A, Hansa Yellow RN, Hansa Yellow R, Banzidine Yellow, Banzidine Yellow G, Benzidine Yellow GR, Permanent Yellow NCG and Quinoline Yellow Lake; and dyes such as Auramine.

The transparent magenta coloring agents used in the magenta ink layer include pigments such as Permanent Red 4R, Brilliant Fast Scarlet, Brilliant Carmine BS, Permanent Carmine FB, Lithol Red, Permanent Red F5R, Brilliant Carmine 6B, Pigment Scarlet 3B, Rhodamine Lake Y and Alizarine Lake; and dyes such as Rhodamine.

The transparent cyan coloring agents used in the cyan ink layer include pigments such as Victoria Blue Lake, metal-free Phthalocyanine Blue, Phthalocyanine Blue and Fast Sky Blue; and dyes such as Victoria Blue.

The transparent coloring agent is used in an amount ranging from 1 to 20% (% by weight, hereinafter the same), preferably from 5 to 15%, based on the weight of each heat-sensitive transfer ink layer. When the content of the coloring agent is more than the above range, the transparency of the ink layer is lowered so that color reproduction becomes difficult, and when the content of the coloring agent is less than the above range, a tinting strength of the ink layer is lowered.

The heat-sensitive transfer ink layer is composed of a transparent coloring agent and a transparent hot-melt vehicle composed of binder, softening agent, etc.

The transfer ink layer is formed by coating a heat-sensitive transfer ink composition onto a foundation. Preferably, the transfer ink composition contains 1 to 20% of a coloring agent, 20 to 80% of a binder and 3 to 25% of a softening agent, based on the total dry weight of the ink composition. The coating may be carried out by hot-melt coating or solvent coating. The thickness of the transfer ink layer is usually selected from 1 to 10 μm.

As a binder, it is preferable to employ solid waxes having a penetration (provided in JIS K 2530) of 10 to 30 (at 25° C.) in order to improve the heat sensitivity of the resulting transfer ink layer. Examples of such waxes are carnauba wax, microcrystalline wax, haze wax, bees wax, ceresine wax and spermaceti. The solid wax may be employed in combination with an easily hot-meltable material such as a low molecular weight polyethylene, oxidized wax or ester wax, as occasion demands.

As a softening agent, it is preferable to employ easily hot-meltable materials such as petroleum resins, polyvinyl acetate, polystyrene, styrene-butadiene copolymer, cellulose esters, cellulose ethers and acrylic resins, and lubricating oils such as mineral oils.

In order to provide the heat-sensitive transfer ink layer with good melt-transferability, an extender pigment may be added to the heat-sensitive transfer ink composition. Preferably the extender pigment is also transparent. Examples of the transparent extender pigment are magnesium carbonate (magnesium hydrogen carbonate), calcium carbonate (precipitated calcium carbonate), kaolin clay (aluminum silicate), sericite (basic potassium aluminum silicate), high dispersive silicic acid anhydride (commercially available under the name "Aerosil" made by Nippon Aerosil Kabushiki Kaisha) and white carbon (precipitated silica). The extender pigment is employed in an amount of not more than 10%, preferably 2 to 10%, based on the total dry weight of the heat-sensitive transfer ink composition.

Further, a finely divided heat conductive material may be added to the heat-sensitive transfer ink composition in order to provide the heat-sensitive transfer ink layer with good melt-transferability, unless the heat conductive material hinders the transparency of the ink layer. The preferred heat conductive material has a heat conductivity of $6.0\times10^{-4}$ to $25.0\times10^{-4}$ cal./sec.cm. °C. Examples of the heat conductive material are powders of metals such as aluminum, copper, tin and zinc. The heat conductive material is employed in an amount of not more than 30%, preferably 3 to 30%, based on the total dry weight of the ink composition.

From the view point of melt-transferability, it is desirable that the resulting respective heat-sensitive transfer ink layers have a melting point of 50° to 150° C. and a viscosity of 20 to 10,000 cP. at a temperature 30° C. higher than the melting point. Also, it is desirable that the transfer ink layers are rather hard, since soft layers are easily soiled, and therefore the transfer ink layers having a penetration of 0.1 to 50 are preferred.

The heat-sensitive color transfer recording media of the present invention may further include a heat-sensitive transfer ink layer of black color in addition to the transfer ink layers of yellow, magenta and cyan colors for the purpose of reproducing sharp black image. The black transfer ink layer is formed from a heat-sensitive transfer ink composition containing a black coloring agent such as carbon black or Nigrosine Base. The ink composition for the black transfer ink layer may have a formulation similar to the ink compositions for the transfer ink layers of yellow, magenta and cyan colors except the coloring agent. However, the black transfer ink layer may be not necessarily transparent, since usually the black image is not superimposed with the yellow, magenta or cyan image.

The continuous foundation used in the invention comprises an electroresistive layer and an electrically conductive layer provided thereon.

The electroresistive layer is a self-supporting resinous layer containing an electrically conductive material and preferably having a thickness of 3 to 25 μm. The electroresistive layer has preferably a resistibity of $10^{-2}$ to $10^{3}$ Ω·cm. A film-forming resin having a relatively high heat resistance is used as a resin for the electroresistive layer. Examples of the resin are polyester, polyethylene, polystyrene, polypropylene, polyimide and polycarbonate. Examples of the electrically conductive material are carbon black, metal powder, etc. The electrically conductive material is used in an amount of 16 to 68 parts by weight per 100 parts by weight of the resin. A mixture of a resin and an electrically conductive material is formed by a usual film-forming method to give a film as an electroresistive layer.

The electrically conductive layer is a deposited layer of a material having a high electric conductivity, such as aluminum and other metals, and metal oxides. Usually, the electrically conductive layer has a thickness of 30 to 200 nm. The electrically conductive layer is usually formed by vacuum deposition of a metal or metal oxide onto the electroresistive layer.

The transfer ink layers of yellow, magenta and cyan colors and if desired, further black color are provided on the above-mentioned continuous foundation in such a manner that the three or four different color ink layers are disposed side by side so as to traverse the continuous foundation without overlapping with each other in a repeating unit. The repeating unit including the three or four different color ink layers is disposed sequentially in the longitudinal direction of the continuous foundation.

The heat-sensitive color transfer recording media of the present invention can be classifed into the following two types:

The recording media of the first type comprises a continuous foundation having a width narrower than the length or width of a copy sheet, for example, a width similar to that of usual ink ribbons, and a multiplicity of coated areas of the above mentioned transparent heat-sensitive transfer inks applied onto the foundation; the multiplicity of the coated areas being disposed on the continuous foundation side by side so as to traverse the continuous foundation; the multiplicity of the coated areas being arranged sequentially in the longitudinal direction of the continuous foundation in a repeating unit which comprises a plurality of different color coated areas; and each of the different color coated areas included in the repeating unit having a length in the longitudinal direction of the continuous foundation substantially equal to the length or width of a copy sheet [the recording media of this type is hereinafter referred to as "recording media (I)"]. The recording media (I) can be suitably used for color recording system using a serial printer.

The recording media of the second type comprises a continuous foundation having a width substantially equal to the length or width of a copy sheet and a multiplicity of coated areas of the above transparent heat-sensitive transfer inks applied onto the foundation; the multiplicity of the coated areas being disposed on the continuous foundation side by side so as to traverse the continuous foundation; the multiplicity of the coated areas being arranged sequentially in the lingitudinal direction of the continuous foundation in a repeating unit which comprises a plurality of different color coated areas; and each of the different color coated areas included in the repeating unit having a size substantially equal to the size of the copy sheet (for example, A4 size) [the recording media of this type is hereinafter referred to as "recording media (II)"]. The recording media (II) can be suitably used for color recording system using a line printer.

The recording media (I) according to the present invention is hereinafter described in detail with reference to the accompanying drawings.

Figure 3:
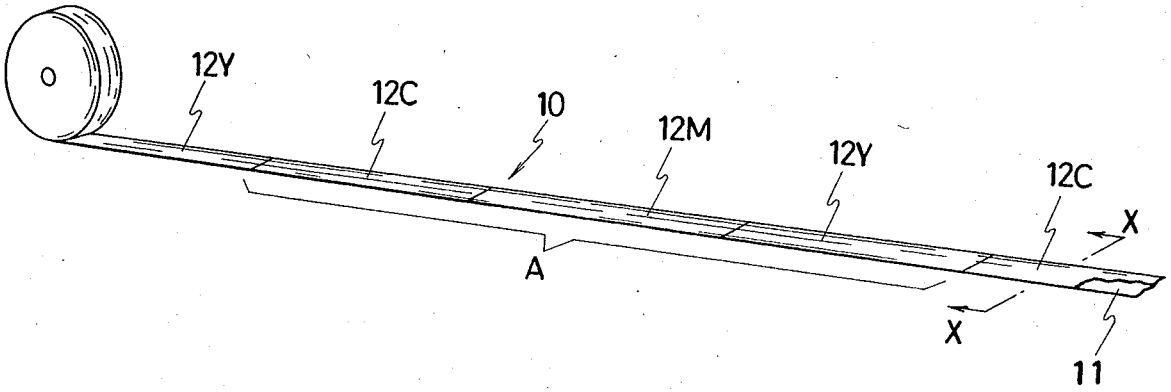
FIG. 3 is a schematic plan view of an embodiment of the heat-sensitive color transfer recording media of the present invention.
Figure 4:
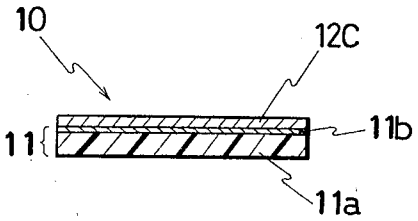
FIG. 4 is a cross-sectional view of the recording media shown in FIG. 3 taken along the line X—X.
Figure 5:
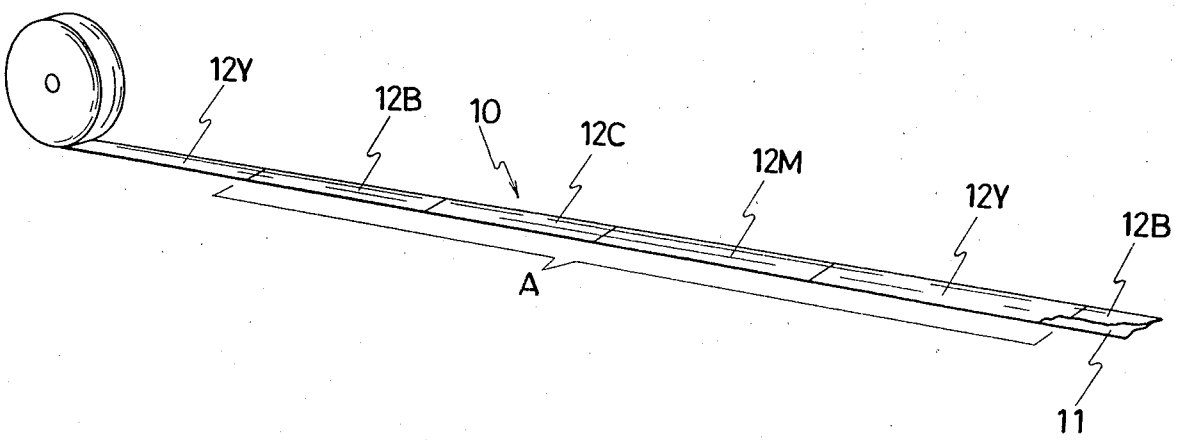
FIG. 5 is a schematic plan view showing a modified embodiment of the recording media shown in FIGS. 3 and 4.
Figure 6A:
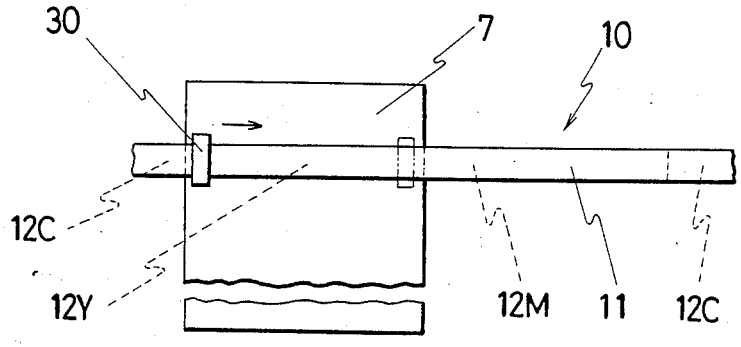
FIGS. 6A, 6B and 6C are schematic views showing a manner of forming a color image using the recording media shown in FIGS. 3 and 4.
Figure 6B:
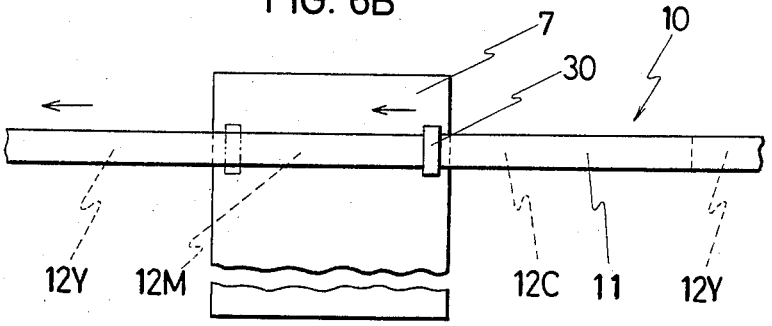
Figure 6C:
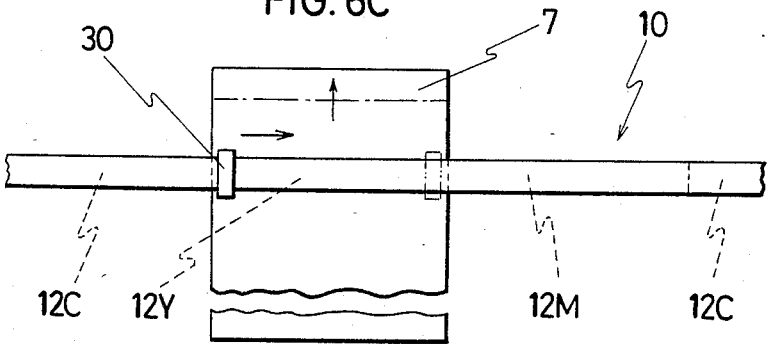

FIG. 3 is a schematic plan view showing an embodiment of the recording media (I). FIG. 4 is a cross-sectional view of the recording media of FIG. 3 taken along the line X—X. FIG. 5 is a schematic plan view of another embodiment of the recording media (I). FIGS. 6A, 6B and 6C schematically illustrate a manner of forming a color image using the recording media (I).

As shown in FIGS. 3 and 4, the recording media (I) designated by reference number 10 comprises a continuous foundation 11 having a width narrower than the length (or width) of a copy sheet and transparent heat-sensitive transfer ink layers 12Y, 12M and 12C of yellow, magenta and cyan colors provided sequentially on the continuous foundation 11 in a repeating unit A including the three different color ink layers in the longitudinal direction of the foundation 11. The foundation 11 comprises an electroresistive layer 11*a* and an electrically conductive layer 11*b*. The ink layers are provided on the electrically conductive layer 11*b* of the foundation 11.

Alternatively, as shown in FIG. 5, the recording media (I) designated by reference number 10 may have the heat-sensitive transfer ink layers 12Y, 12M and 12C and an additional heat-sensitive transfer ink layer 12B of black color. The four different color ink layers are arranged on the continuous foundation 11 in the same manner as above.

These heat-sensitive transfer ink layers are arranged repeatedly in the longitudinal direction of the foundation 11 in the repeating unit A including the yellow, magenta, cyan ink layers and, if desired, black ink layer, and each of the heat-sensitive transfer ink layers included in each repeating unit A has a length in the longitudinal direction of the foundation 11 substantially equal to the width (or length) of a copy sheet such as plain paper.

FIGS. 6A, 6B and 6C schematically illustrate a manner of forming a color image using the recording media (I) shown in FIGS. 3 and 4. As illustrated in FIG. 6A, the yellow heat-sensitive transfer ink layer 12Y of the recording media 10 is first laid on top of the copy sheet 7 in such a manner that the ink layer 12Y is facing to the copy sheet 7 over its entire width. The yellow ink layer 12Y is then melt-transferred imagewise onto the copy sheet 7 activated by a yellow signal Y with the heat due to the electric current from a serial printing head 30 composed of a plurality of electrodes which moves from one end of the copy sheet 7 to the other end along the back surface of the recording media 10. The main part of the head 30 has the same construction as that of the head 110 shown in FIG. 1. As shown in FIG. 6B, when the head 30 reaches the other end of the copy of sheet 7, the head 30 is then returned to the original position and, at the same time, the recording media 10 is moved in the same direction as the returning head (right to left in FIG. 6B), whereby the subsequent magenta ink layer 12M is laid on top of the copy sheet in such a manner that the magenta ink layer 12M is facing to the copy sheet at the same position as the imprinted yellow image. The magenta ink layer 12M is then melt-transferred imagewise onto the yellow image of the copy sheet activated by a magenta signal M in the same manner as in the case of the formation of the yellow image as shown in FIG. 6A to give a magneta image on the yellow image. Then, the cyan ink layer 12C is laid on top of the copy sheet 7 in the same manner as above and the cyan ink layer is melt-transferred imagewise onto the magenta image of the copy sheet activated by a cyan signal C in the same manner as above to give a cyan image on the magenta image.

After completion of the color image formation on the copy sheet 7 in an area corresponding to the width of the recording media 10, the copy sheet 7 is shifted perpendicularly to the travel direction of the recording media 10 by a distance corresponding to the width of the recording media 10 as shown in FIG. 5C, and the same image forming operation as above is repeated. In this manner, partial color images are formed successively on the copy sheet 7 along the longitudinal direction (or transverse direction) of the copy sheet 7, whereby a complete image identical to one frame of the original can be reproduced on the copy sheet 7.

As described above, the recording media (I) makes it possible to reproduce any desired color image by successively forming yellow, magenta, cyan color images and, if desired, black color image on copy sheet 7, from one end to the other of the copy sheet 7 in section-wise (one section approximately corresponding to the width of the.recording media 10 or the length of the serial printing head 30) and superimposing the color images in each section. Thus, the recording media (I) can be used in color transfer recording according to a so-called "serial frame scanning recording system".

Since the recording media (I) has a small size, i.e. a width of 3 to 35 mm., and the electroresistive printing head used therefor is a serial head, the recording media (I) is very advantageous in that the electroresistive printing apparatus can be reduced in its size and can be manufactured at low cost.

The recording media (II) according to the present invention is hereinafter described in detail with reference to the accompanying drawings.

Figure 7:
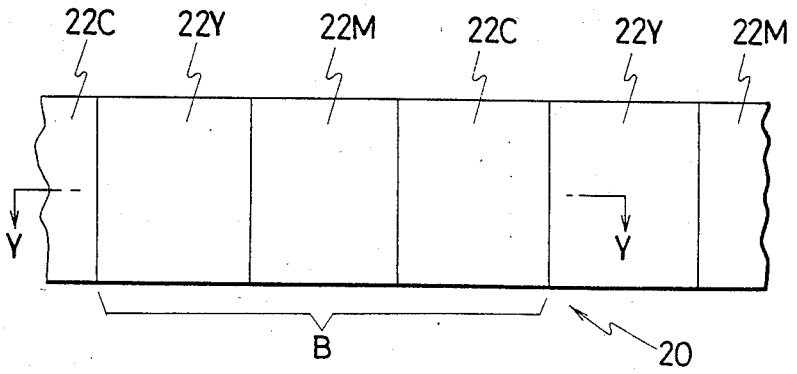
FIG. 7 is a schematic plan view showing another embodiment of the recording media according to the present invention.
Figure 8:
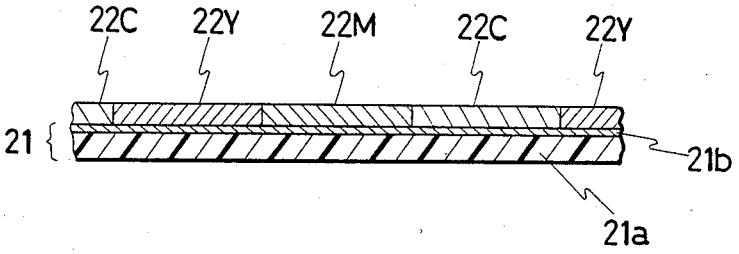
FIG. 8 is a cross-sectional view of the recording media shown in FIG. 7 taken along the line Y—Y.
Figure 9:
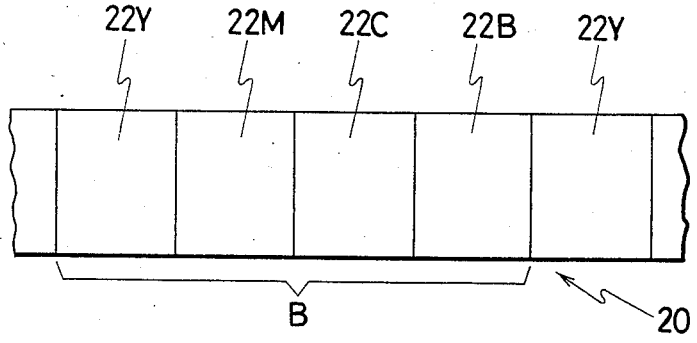
FIG. 9 is a schematic plan view showing a modified embodiment of the recording media shown in FIGS. 7 and 8.
Figure 10:
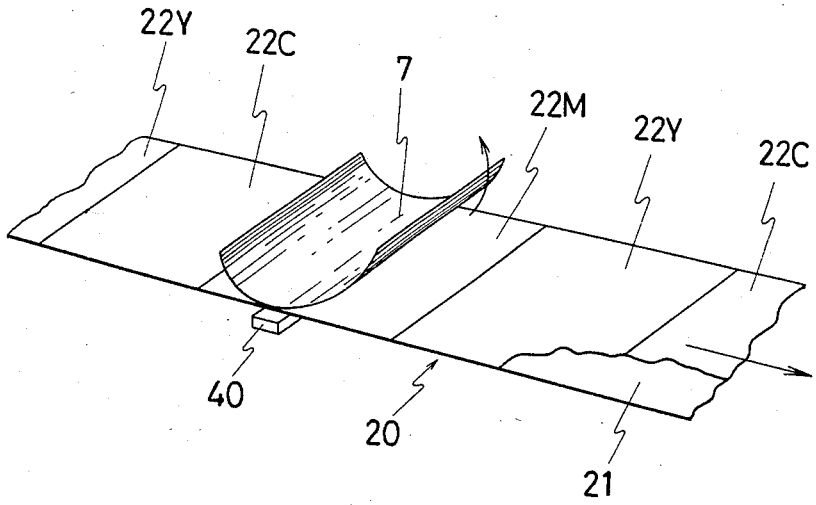
FIGS. 10 and 11 are schematic views showing a manner of forming a color image using the recording media shown in FIGS. 7 and 8.
Figure 11:
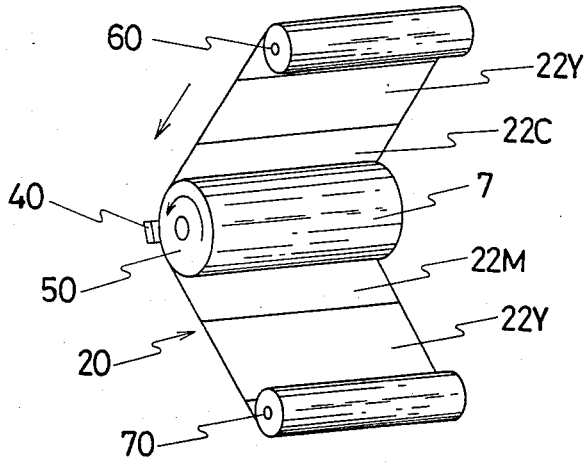

FIG. 7 is a schematic plan view showing an embodiment of the recording media (II), FIG. 8 is a schematic cross-sectional view of the recording media of FIG. 7 taken along the line Y—Y, FIG. 9 is a schematic plan view showing another embodiment of the recording media (II), FIGS. 10 and 11 illustrate a manner of forming a color image using the recording media (II).

As shown in FIGS. 7 and 8, the recording media (II) designated by reference number 20 comprises a continuous foundation 21 having a width substantially equal to the width (or length) of a copy sheet and transparent heat-sensitive transfer ink layers 22Y, 22M and 22C of yellow, magenta and cyan colors provided sequentially on the continuous foundation 21 in a repeating unit B including the three different color ink layers in the longitudinal direction of the foundation 21. The foundation 21 comprises an electroresistive layer 21*a* and an electrically conductive layer 21*b*. The ink layers are provided on the electrically conductive layer 21*b* of the foundation 21.

Alternatively, as shown in FIG. 9, the recording media (II) may have the transfer ink layers 22Y, 22M and 22C and additionally a heat-sensitive transfer ink layer 22B of black color. The four different color layers are arranged on the foundation 21 in the same manner as above.

These heat-sensitive transfer ink layers are arranged repeatedly in the repeating unit B including the yellow, magenta and cyan ink layers and, optionally, black ink layer, and each of the heat-sensitive transfer ink layers included in each repeating unit B has a size substantially equal to that of a copy sheet 7 such as plain paper, for example, A4 size, B5 size, etc.

FIG. 10 schematically illustrates a manner of forming a color image using the recording media (II) shown in FIGS. 7 and 8. As shown in FIG. 10, the recording media 20 is carried in one direction over a line printing head 40 composed of a plurality of electrodes. The main part of the head 40 has the same construction as that of the head 110 shown in FIG. 1. The head 40 comes in contact with the uncoated surface of the recording media 20 and the surface having the heat-sensitive transfer ink layers 22Y, 22M and 22C comes in contact with the copy sheet 7. The recording media 20 and the copy sheet 7 are brought into contact on the line head 40 while they are being moved in one direction at a constant rate and the heat-senstitive transfer ink layers are melt-transferred imagewise on the copy sheet 7 with the heat due to the electric current from the line head 40.

More specifically, the yellow ink layer 22Y in one repeating unit B of the recording media is transferred imagewise onto the copy sheet 7 activated by a yellow signal Y to give a yellow image on the copy sheet 7 and thereafter the copy sheet 7 is returned to the line head 40 and brought into contact with the magenta ink layer 22M on the line head 40, whereby the magenta ink layer 22M is imagewise transferred onto the copy sheet 7 activated by a magenta signal M to give a magenta image. After the formation of the magenta image, the copy sheet 7 is again returned to the line head 40 and the cyan ink layer 22C is imagewise transferred onto the copy sheet 7 activated by a cyan signal C in the same manner as above to give a cyan image on the magenta image.

In this manner, the yellow, magenta and cyan images corresponding to one frame of the original are successively formed over a whole area of one copy sheet 7. As a result, any desired color image can be reproduced on the copy sheet by superimposing an appropriate combination of yellow, magenta and cyan color images over a whole area of the copy sheet 7. For example, a black image can be reproduced on an area of the copy sheet 7 corresponding to black color of the original by superimposing the yellow, magenta and cyan colors.

As described above, the recording media (II) makes it possible to reproduce any desired color image by successively forming yellow, magenta and cyan color images on a copy sheet 7 every frame. Thus, the recording media (II) can be used in color transfer recording according to serial frame scanning recording system.

FIG. 11 shows a preferred embodiment for practising the color image forming process shown in Fig. 10. In this embodiment, the copy sheet 7 is wound around a drum 50 so that the both ends of the copy sheet are brought into contact with each other, and the copy sheet 7 faces the line head 40 interposing the recording media 20. The recording media 20 is supplied from a feed roll 60 to the line head 40 at a constant rate and is taken up at a wound roll 70. Each of the heat-sensitive transfer ink layers 22Y, 22M and 22C has the same size as that of the copy sheet 7 has the same size as that of the copy sheet 7 and the drum 50 on which the copy sheet 7 has been wound is rotated at the same linear velocity with the recording media 20, whereby any print shear among the yellow, magenta and cyan color images formed on the copy sheet 7 can be prevented. Thus, the process is very advantageous since the machanism of the printer to be used for electroresistive recording can be simplified and the printer can be operated easily.

The above electroresistive line printing head 40 is facing to the recording media 20 over the entire width of the recording media 20 and is a line head similar to that used in a conventional line printer. The head 40 is preferably those having not less than 6 electrodes, more preferably 8 to 16 electrodes, per 1 mm. in order to obtain a color image with a high resolution.

The recording media (II) has an advantage that it can be used in a line printer which enables high speed printing.

The recording media (I) and (II) have been described with reference to the color image formation on the copy sheet 7 in the order of the yellow, magent and cyan colors, but it is to be understood that the order is not limited thereto.

In the present invention, the heat-sensitive transfer ink layers 12Y, 12M, 12C and 12B, or 22Y, 22M, 22C and 22B may be provided on the foundation with a space between the adjacent different color ink layers, but it is preferable that these ink layers are provided on the foundation in close contact with each other from the standpoint of ease of printing operation. In order to provide the ink layers in close contact with each other, any coating method which is conventionally used in the filed of color printing can be used, including letterpress, gravure, flexograph, silk screen, and the like.

As described above, the recording media of the present invention can be employed suitably in a novel electroresistive color recording system wherein the heat-sensitive transfer ink layers of at least three colors of yellow, magenta and cyan 12Y, 12M and 12C (or 22Y, 22M and 22C) are successively melt-transferred imagewise onto the copy sheet 7 with the heat due to electric current from the electroresistive printing head 30 (or 40), thereby superimposing the different color images to reproduce a clear multi-color image on the copy sheet 7. Accordingly, the electroresistive color recording system using the recording media of the present invention does not require color printers and color facsimile equipments of complicated mechanism, but permits the use of simple, low cost equipment which is reliable and easy to operate.

Thus, the recording media of the present invention can greatly contribute to practical use of color printer and color facsimile equipment in electroresistive transfer recording.

Further, since the recording meida of the present invention has an excellent melt-transferability, the amount of the ink layer to be transferred on the copy sheet 7 can be easily adjusted by varying input strength of pulse signals to the head 30 or 40, whereby a color image having various color tones including medium tone faithful to the original can be reproduced. In addition, the recording media of the present invention has excellent effects that the reproduced image is color fast and, moreover, since plain papers can be used as the copy sheet, the running cost of color recording can be markedly reduced.

The recording media of the present invention greatly contributes to practical use of color printer, color facsimile, color video printer, color copy machine, etc. which employ a printer for electroresistive printing and, therefore, are greatly valuable.

The present invention is more particularly described and explained by means of the following Examples. These Examples are intended to illustrate the invention and not be construed to limit the scope of the invention. It is to be understood that various changes and modifications may be made in the invention without departing from the spirit and scope thereof.

EXAMPLE 1

There was prepared as a foundation a continuous film composed of a polyester film in which 40 parts by weight of carbon black per 100 parts by weight of a polyester resin was uniformly dispersed and which had a thickness of 9 μm. and a resistivity of 1.5 Ω·cm., and an aluminum layer vacuum-deposited on the polyester film and having a thickness of 100 nm. The foundation had a width of 8 mm.

Yellow, magenta and cyan color heat-sensitive transfer ink compositions shown in Table 1 were applied by hot-melt coating onto the aluminum layer of the above foundation so that each of resulting ink layers had a length of 210 mm., which corresponded to the width of A4 size, in longitudinal direction of the foundation to give a recording media having repeating three different color heat-sensitive transfer ink layers as illustrated in FIGS. 3 and 4. Each of the three different color heat-sensitive transfer ink layers had a thickness of 5 μm., a melting point of 90° C., a viscosity of 250 cP. (at 120° C.) and a penetration of 2. The visible light transmittances of the yellow ink layer, the magenta ink layer and the cyan ink layer were 85%, 80% and 81%, respectively.

TABLE 1

| Components | Heat-sensitive transfer ink composition (parts by weight) Yellow ink | Magenta ink | Cyan ink |
|---|---|---|---|
| Transparent coloring agent | | | |
| Benzine Yellow G (C.I. 21090) | 10 | — | — |
| Rhodamine Lake Y (C.I. 45160) | — | 10 | — |
| Phthalocyanine | — | — | 10 |

TABLE 1-continued

| Components | Heat-sensitive transfer ink composition (parts by weight) Yellow ink | Magenta ink | Cyan ink |
|---|---|---|---|
| Blue (C.I. 74160) | | | |
| Binder | | | |
| Carnauba wax | 30 | 30 | 30 |
| Microcrystalline wax (melting point: 95° C.) | 30 | 30 | 30 |
| Softening agent | | | |
| Petroleum resin | 10 | 10 | 10 |
| Extender pigment | | | |
| Colloidal silica | 10 | 10 | 10 |
| Heat-conductive material | | | |
| Aluminum Powder | 10 | 10 | 10 |

The recording media thus obtained was used to form color images of yellow, magenta and cyan colors successively on an A4 size plain paper as a copy sheet using a monochromatic serial printer for electroresistive printing.

First, the yellow ink layer of the recording media was placed on a plain paper and a yellow image was melt-transferred onto the plain paper by heating with the electroresistive printing head of the printer. The recording media was then shifted so as to place the magenta ink layer on the same place of the paper and a magenta image was formed on the yellow image of the paper in the same manner as above. Finally, a cyan image was formed on the magenta image of the paper in the same manner as above. Thus, there was obtained a superimposed image of yellow, magenta and cyan colors on the paper. The image was clear and had a high resolution.

EXAMPLE 2

A recording media as illustrated in FIG. 5 was prepared in the same manner as described in Example 1, except that a black heat-sensitive transfer ink layer having the following composition was formed on the foundation in addition to the yellow, magenta and cyan ink layers.

| Components | Parts by Weight |
|---|---|
| Carbon black | 10 |
| Carnauba wax | 30 |
| Microcrystalline wax (Melting Point: 95° C.) | 30 |
| Petroleum resin | 10 |
| Colloidal silica | 10 |
| Aluminum powder | 10 |

The recording media thus prepared was used to form a color image on a plain paper in the same manner as in Example 1. The resulting color image was clear and, in particular, had a black color clearer than that of the color image obtained in Example 1.

EXAMPLE 3

A recording media was prepared in the same manner as in Example 1 except that the ink compositions shown in Table 2 were used instead of those shown in Table 1. Each of the three different color ink layers had a thickness of 4.5 μm., a melting point of 85° C. a viscosity of 210 cP. (at 115° C.) and a penetration of 3. The visible light transmittances of the yellow ink layer, the magenta ink layer and the cyan ink layer were 90%, 88% and 87%, respectively.

The obtained recording media was used to form a color image on a plain paper in the same manner as in Example 1. The resulting color image was clear and had a high resolution.

TABLE 2

| Components | Heat-sensitive transfer ink composition (parts by weight) Yellow ink | Magenta ink | Cyan ink |
|---|---|---|---|
| Transparent coloring agent | | | |
| Auramine | 15 | — | — |
| Rhodamine | — | 15 | — |
| Fast Sky Blue | — | — | 15 |
| Binder | | | |
| Carnauba wax | 30 | 30 | 30 |
| Microcrystalline wax (melting point: 95° C.) | 30 | 30 | 30 |
| Softening agent | | | |
| Petroleum resin | 15 | 15 | 15 |
| Extender pigment | | | |
| Colloidal silica | 10 | 10 | 10 |

EXAMPLE 4

A recording media was prepared in the same manner as in Example 1 except that 10 parts by weight of Auramine base, 10 parts by weight of Rhodamine B base and 10 parts by weight of Victoria Blue B base were used as transparent coloring agents for the yellow, magenta and cyan inks, respectively, per 100 parts by weight of the total ink composition.

Each of the heat-sensitive transfer ink layers thus obtained had a thickness of 5 μm., a melting point of 90° C., a viscosity of 300 cP. (at 120° C.) and a penetration of 4. The visible light transmittances of the yellow, magenta and cyan ink layers was 91%, 87% and 84%, respectively.

The obtained recording media was used to form a color image in the same manner as in Example 1. The resulting color image was clear and had a high resolution.

EXAMPLE 5

The yellow, magenta and cyan color heat-sensitive transfer ink compositions as shown in Table 1 were applied by hot-melt coating onto a continuous foundation which had the same construction as that of the foundation used in Example 1 except that the width was 297 mm. The coatings were applied so that each of the three different color ink layers had a length of 210 mm. in the longitudinal direction of the foundation and a thickness of 5 μm. to give a recording media having repeating three different color heat-sensitive transfer ink layers of A4 size as shown in FIGS. 7 and 8.

The recording media thus obtained was used to form a color image by superimposing yellow, magenta and cyan images on an A4 size plain paper using an electroresistive printing apparatus having a monochromic line head.

The experiment was conducted as follows: The yellow ink layer of the recording media was laid on top of a plain paper and melt-transferred by heating with the line head to give a yellow image on the paper. Then, the magenta ink layer was laid on top of the paper and melt-transferred to give a magenta image on the yellow image of the paper in the same manner as above, and finally a cyan image was formed on the magenta image of the paper in the same manner as above. The resulting color image formed by superimposing the yellow, magenta and cyan images was clear and had a high resolution.

EXAMPLE 6

A recording media as shown in FIG. 9 was prepared in the same manner as in Example 5, except that a black heat-sensitive transfer ink layer was added by using the same black ink used in Example 2.

The recording media thus obtained was used to form a color image on paper in the same manner as in Example 5. The resulting color image was clear and, in particular, had a black color clearer than that of the color image obtained in Example 5.

EXAMPLE 7

A recording media was prepared in the same manner as in Example 5 except that the ink compositions shown in Table 2 were used instead of those shown in Table 1.

EXAMPLE 8

A recording media was prepared in the same manner as in Example 5 except that 10 parts by weight of Auramine base, 10 parts by weight of Rhodamine B base and 10 parts by weight of Victoria Blue B base were used as transparent coloring agents for yellow, magenta and cyan inks, respectively, per 100 parts by weight of the total ink composition.

Each of the heat-sensitive transfer ink layers thus obtained had a thickness of 5 μm., a melting point of 90° C., a viscosity of 300 cP. (at 120° C.) and a penetration of 4.

Each of the recording media obtained in Examples 7 and 8 was used to form a color image in the same manner as in Example 5. The resulting color image in each instance was clear and had a high resolution.

What is claimed is:

1. A heat-sensitive color transfer recording media which comprises foundation comprising an electroresistive layer, adapted to be contacted by an electrode, an electrically conductive layer on one side thereof having a thickness of 30 to 200 nm and a multiplicity of coated areas of heat sensitive transfer inks applied on the other side of the electrically conductive layer of the foundation; the multiplicity of the coated areas being disposed on the continuous foundation side by side so as to transverse the continuous foundation; the multiplicity of the coated areas being arranged sequentially in the longitudinal direction of the continuous foundation in a repeating unit which comprises a plurality of different color coated areas; each of the different color coated areas included in the repeating unit having a length in the longitudinal direction of the continuous foundation substantially equal to one of the length and width of a receiving medium; each of the heat-sensitive transfer ink layers of the coated areas being a transparent ink layer comprising a transparent coloring agent and a transparent hot-melt vehicle; and said plurality of the different color heat-sensitive transfer ink layers of the coated areas of the recording media capable of being transferred onto the receiving medium so that different substantially permanently-existing color ink images are superimposed on the receiving medium to provide a color image.

2. The recording media of claim 1, in which the plurality of the different color ink layers are three ink layers of yellow, magenta and cyan colors.

3. The recording media of claim 2, in which the repeating unit includes a black color heat-sensitive transfer ink layer in addition to the three ink layers of yellow, magenta and cyan colors.

4. The recording media of claim 1, 2 or 3, in which each of the heat-sensitive transfer ink layers comprises 1 to 20% by weight of a coloring agent, 20 to 80% by weight of a binder and 3 to 25% by weight of a softening agent, based on the weight of each ink layer.

5. The recording media of claim 1, 2 or 3, in which each of the heat-sensitive transfer ink layers has a thickness of 1 to 10 μm.

6. The recording media of claim 1, 2 or 3, in which each of the heat-sensitive transfer ink layers has a melting point of 50° to 150° C., a viscosity of 20 to 10,000 cP. at a temperature 30° C. higher than the melting point of each ink layer and a penetration of 0.1 to 50.

7. The recording media of claim 1, 2 or 3, in which the electroresistive layer is a heat-resistant polymer film in which an electrically conductive material is incorporated and which has a thickness of 3 to 25 μm., and the electrically conductive layer is a metal or metal oxide layer deposited on the polymer film.

8. The recording media of claim 1, 2 or 3, in which the continuous foundation has a width narrower than the length or width of the copy receiving medium.

9. The recording media of claim 1, 2 or 3, in which the continuous foundation has a width substantially equal to the one of the length and width of the receiving medium, each of the different color coated areas included in the repeating unit having a size substantially equal to the size of the receiving medium.

10. The recording medium of claim 1, wherein the transfer ink layers have a thickness of 1 to 10 μ, a melting point of 50 degrees C. to 150 degrees C., a viscosity of 20 to 10,000 cP at a temperature higher than the melting point by 30 degrees C., and a penetration of 0.1 to 50, and containing 1 to 20% by weight of a coloring agent, 20 to 80% by weight of a solid wax as a binder and 3 to 25% by weight of a softening agent; said coloring agent being at least one of dye and inorganic pigments, the organic pigments being those capable of coloring the transfer ink layer substantially transparently when dispersed into the vehicle composed of the wax and the softening agent.

11. A process for producing a color image comprising the steps of:

providing a heat-sensitive color transfer recording media which comprises a continuous foundation comprising an electroresistive layer, adapted to be contacted by an electrode, and an electrically conductive layer on one side thereof having a thickness of 30 to 200 nm, and a multiplicity of coated areas of heat-sensitive transfer inks applied on the other side thereof electrically conductive layer of the foundation; the mulitiplicity of the coated areas being disposed on the continuous foundation side by side so as to transverse the continuous foundation; the multiplicity of the coated area being arranged sequentially in the longitudinal direction of the continuous foundation in a repeating unit which comprises a plurality of different color coated areas; each of the different color coated areas included in the repeating unit having a length in the longitudinal direction of the continuous foundation substantially equal to one of the length and width of a receiving medium; and each of the heat-sensitive transfer ink layers of the coated areas being a transparent ink layer comprising a transparent color agent and a transparent hot-melt vehicle;

superimposing the respective different color coated areas of the recording media on a receiving medium over one of its entire width and length at every coated area, and successively transferring imagewise the respective different color transfer ink layers of the coated areas on the receiving medium by means of an electroresistive printing head composed of a plurality of electrodes at every coated area so that the resulting different color images in the form of substantially permanent-existing layers are superimposed with each other on the receiving medium to provide a color image.

12. The process of claim 11, wherein the transfer ink layers have a thickness of 1 to 10, a melting point of 50 degrees C. to 150 degrees C., a viscosity of 20 to 10,000 cP at a temperature higher than the melting point by 30 degrees C., and a penetration of 0.1 to 50, and containing 1 to 20% by weight of a coloring agent, 20 to 80% by weight of a solid wax as a binder and 3 to 25% by weight of a softening agent; said coloring agent being at least one of dye and inorganic pigments, the organic pigments being those capable of coloring the transfer ink layer substantially transparently when dispersed into the vehicle composed of the wax and the softening agent.

* * * * *

UNITED STATES PATENT AND TRADEMARK OFFICE

CERTIFICATE OF CORRECTION

PATENT NO. : 4,588,315

DATED : May 13, 1986

INVENTOR(S) : Tadao SETO et al

It is certified that error appears in the above-identified patent and that said Letters Patent is hereby corrected as shown below:

Column 2, line 25, "heat-sentive" should read --heat sensitive--.

Column 4, line 46, "indicies" should read --indices--.

Claim 1, line 2, "foundation" should read --a continuous foundation--.

Claim 10, line 5, "melting" should read --melting--; lines 9 and 10, "and inorganic pigments, the organic pigments being" should read --and organic pigment, the organic pigment being--.

Claim 12, lines 9 and 10, "and inorganic pigments, the organic pigments being" should read --and organic pigment, the organic pigment being--.

Signed and Sealed this

*Twenty-third* Day of *September 1986*

[SEAL]

*Attest:*

DONALD J. QUIGG

*Attesting Officer*

*Commissioner of Patents and Trademarks*